US007367546B1

(12) United States Patent
Rodriguez

(10) Patent No.: US 7,367,546 B1
(45) Date of Patent: May 6, 2008

(54) TIRE JACK

(76) Inventor: Rosa M. Rodriguez, P.O. Box 153, Cost, TX (US) 78614

( * ) Notice: Subject to any disclaimer, the term of this patent is extended or adjusted under 35 U.S.C. 154(b) by 0 days.

(21) Appl. No.: 11/544,510

(22) Filed: Oct. 6, 2006

Related U.S. Application Data

(60) Provisional application No. 60/725,076, filed on Oct. 7, 2005.

(51) Int. Cl.
*B66F 3/00* (2006.01)

(52) U.S. Cl. ..... 254/126; 254/134; 254/2 B

(58) Field of Classification Search ..... 254/126, 254/2 B, 133 R, 134, 124
See application file for complete search history.

(56) References Cited

U.S. PATENT DOCUMENTS 5,803,437 A * 9/1998 Paterson et al. ..... 254/343
6,409,153 B1 * 6/2002 Norris ..... 254/93 R
6,416,039 B1 * 7/2002 Pietrusynski ..... 254/8 B
6,772,997 B2 * 8/2004 Keaton et al. ..... 254/90
2003/0213653 A1 * 11/2003 Morris ..... 187/269

* cited by examiner

*Primary Examiner*—Lee D Wilson
(74) *Attorney, Agent, or Firm*—Kenneth L Tolar

(57) ABSTRACT

A tire jack for lifting a spare tire onto a vehicle wheel includes a base component with a lifting pan superimposed thereon. A rotatable drive shaft raises and lowers a lifting arm, which in turn raises and lowers the lifting pan relative to the base component. On an upper surface of the lifting pan are a plurality of juxtaposed rollers arranged in a concave configuration so as to readily conform to a vehicle tire. Accordingly, a user places a spare tire on the concave roller assembly and raises the lifting arm to conveniently elevate the spare tire onto the wheel.

15 Claims, 2 Drawing Sheets

TIRE JACK

CROSS REFERENCE TO RELATED APPLICATIONS

This application is entitled to the benefit of provisional application No. 60/725,076 filed on Oct. 7, 2005, the specification of which is incorporated herein by reference.

BACKGROUND OF THE INVENTION

The present invention relates to a vehicle jack for elevating a spare tire during installation.

DESCRIPTION OF THE PRIOR ART

Changing a flat tire has always been strenuous, particularly with a larger truck tire. The flat tire must first be removed from an elevated wheel and the spare tire must then be lifted and mounted thereon. Lifting a heavy tire onto the wheel can be strenuous, particularly for the elderly or others with certain physical limitations. Accordingly, there is currently a need for a device that eliminates the strain associated with lifting a spare tire. The present invention addresses this need by providing a uniquely designed tire jack that elevates a spare tire allowing a user to easily place it onto an elevated wheel.

SUMMARY OF THE INVENTION

A tire jack for lifting a spare tire onto a vehicle wheel includes a base component with a lifting pan superimposed thereon. A rotatable drive shaft raises and lowers a lifting arm, which in turn raises and lowers the lifting pan relative to the base component. On an upper surface of the lifting pan are a plurality of juxtaposed rollers arranged in a concave configuration so as to readily conform to a vehicle tire. Accordingly, a user places a spare tire on the concave roller assembly and raises the lifting arm to conveniently elevate the spare tire onto the wheel.

It is therefore an object of the present invention to provide a tire jack that assists a user with elevating and lowering tires relative to a raised wheel.

It is another object of the present invention to provide a tire jack that significantly reduces the stress and strain associated with changing a vehicle tire.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
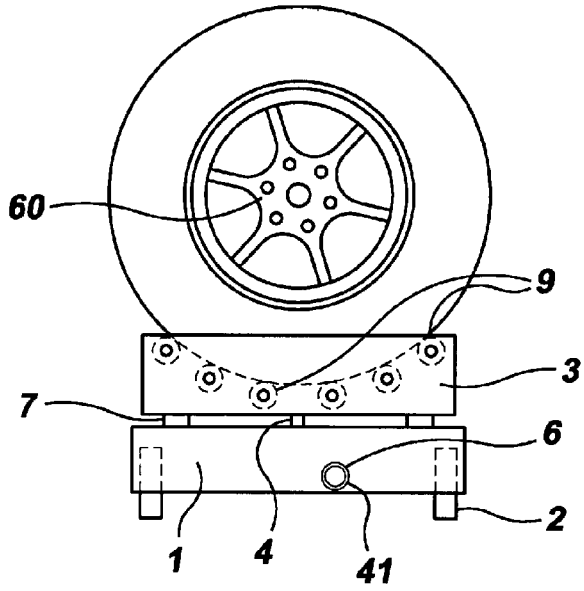
FIG. 1 is a front view of the tire jack with a tire resting thereon.
Figure 2:
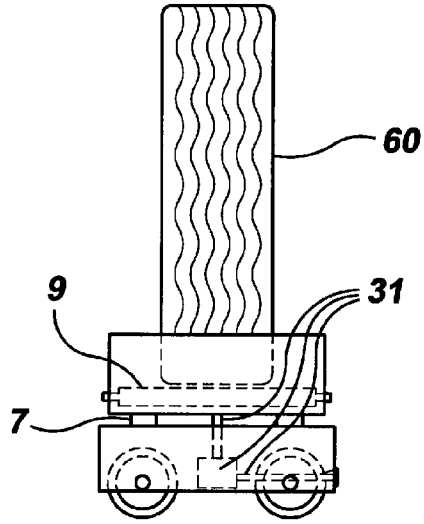
FIG. 2 is a side view of the tire jack with the tire resting thereon.
Figure 3:
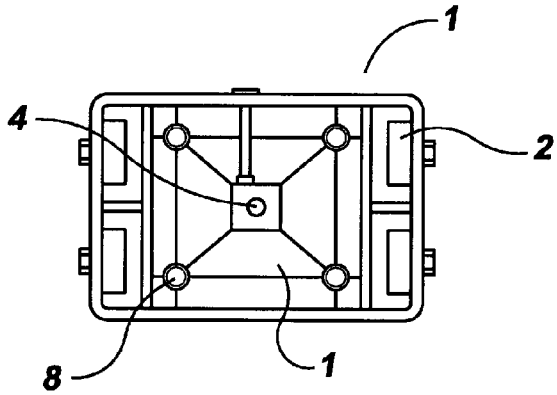
FIG. 3 is a top view of the base pan.
Figure 4:
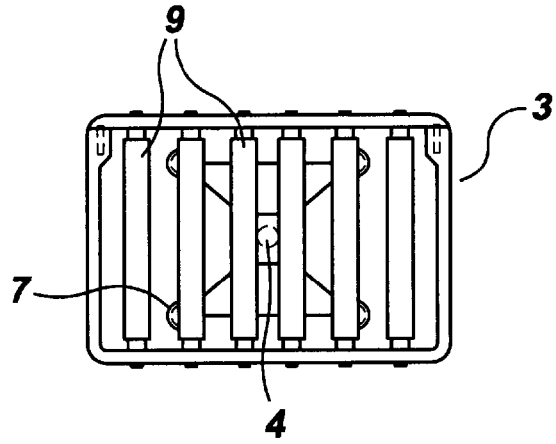
FIG. 4 is a top view of the lifting pan.
Figure 5:
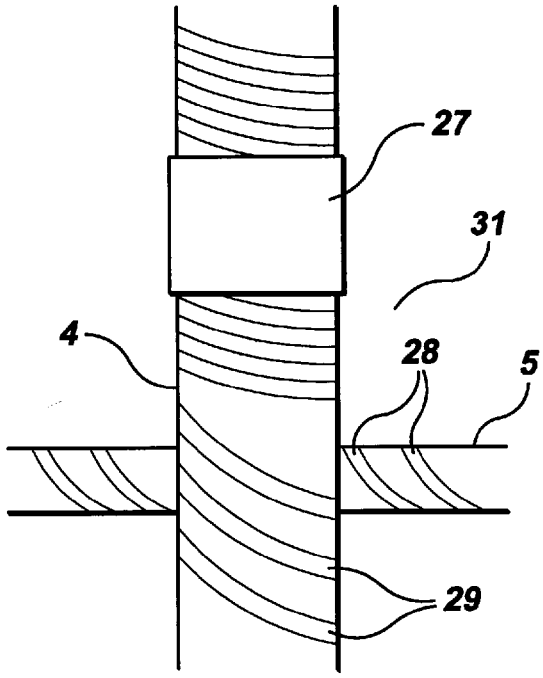
FIG. 5 is an isolated view of the lifting means.

The present invention relates to a uniquely designed tire jack. The device comprises a base pan 1 mounted on a plurality of wheels 2 allowing the jack to easily roll along an underlying surface. Superimposed on the base pan is a lifting pan 3 having a substantially open top.

A lifting means 31 is positioned within the base pan for elevating and lowering the lifting pan. The lifting means includes a lifting arm 4 threadedly received within a fixed ball nut 27. A lower end of the lifting arm includes a worm gear 29 while an upper end is fixedly connected to the lower surface of the lifting pan. A horizontal drive shaft 5 is received within the base pan having a worm gear 28 at a first end that engages the worm gear 29 on the lifting arm; at an opposing end of the drive shaft is a sleeve 6 that is positioned on an outer edge of the base pan; the sleeve includes a receptacle 41 that is dimensioned and configured to tightly receive the flat end of a lug wrench whereby rotation of the lug wrench rotates the drive shaft to raise and lower the lifting arm, and thus, the lifting pan. The worm gear mechanism provides a secure locking assembly that fixes the lifting platform at a select elevation regardless of the load thereon; the drive shaft worm gear easily rotates the lifting arm worm gear, but not vice versa, because the fixed ball nut prevents axial movement of the lifting arm unless the drive shaft is rotated.

The lifting pan also includes a plurality of shafts 7 depending therefrom, each of which is received within a corresponding bore 8 on the base pan; the shafts provide a bearing surface and assure that the lifting pan remains substantially horizontal during lifting and lowering. Within the open upper end of the lifting pan are a plurality of juxtaposed rollers 9 arranged in a substantially concave fashion so as to readily conform to a vehicle tire 60. The rollers allow a user to angularly orient the tire when aligning the wheel lugs with the tire lug apertures.

Accordingly, to change a vehicle tire, a user elevates the flat tire using a conventional vehicle jack. The lifting platform is elevated by inserting a lug nut wrench into the receptacle and rotating the wrench until the rollers are adjacent or immediately beneath a lower edge of the flat tire. The flat tire is removed and placed onto the rollers, the platform is lowered and the flat tire is removed. The spare tire then is placed on the lifting pan and the pan is again elevated until the spare tire lug apertures are aligned with the lugs on the vehicle wheel. The device can be rolled toward the wheel, if necessary, to mount the tire thereon. Once the spare tire is properly secured to the wheel, the lifting pan is lowered and stored.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A tire jack comprising:

a base pan;

a lifting pan superimposed on the base pan, said lifting pan having a substantially open top configured to support a tire;

a lifting means positioned within the base pan for elevating and lowering the lifting pan to and from a level corresponding to that of a raised vehicle wheel, wherein said lifting means includes a threaded lifting arm received within a fixed threaded nut, said lifting arm having an upper end and a lower end, said lower end having a first worm gear thereon, said upper end fixedly connected to said lifting pan, and a horizontal drive shaft having a first end and a second end, the first end having a second worn gear thereon that engages said first worm gear whereby rotation of said drive shaft results in rotation of said lifting arm through said threaded nut thereby raising and lowering said lifting arm.

2. The tire jack according to claim 1 wherein said drive shaft includes a sleeve at the second end thereof, said sleeve having a receptacle that is dimensioned and configured to tightly receive a lug wrench whereby rotation of the lug wrench rotates the drive shaft to raise and lower the lifting arm, and thus, the lifting pan.

3. The tire jack according to claim 1 wherein said base pan is mounted on a plurality of wheels allowing said base pan to easily roll along an underlying surface.

4. The tire jack according to claim 1 wherein said lifting pan includes a plurality of shafts depending therefrom, each of said shafts received within a designated bore on the base pan, said shafts providing a bearing surface while assuring that the lifting pan remains substantially horizontal during lifting and lowering.

5. The tire jack according to claim 1 further comprising a plurality of juxtaposed rollers positioned within the open top of the lifting pan, said rollers arranged in a substantially concave fashion so as to readily conform to a vehicle tire and to assist a user in angularly orienting the tire when aligning wheel lugs with lug apertures on the tire.

6. A tire jack comprising:

a base pan;

a lifting pan superimposed on the base pan, said lifting pan having a substantially open top configured to support a tire, said lifting pan including a plurality of shafts depending therefrom, each of said shafts received within a designated bore on the base pan, said shafts providing a bearing surface while assuring that the lifting pan remains substantially horizontal during lifting and lowering;

a lifting means positioned within the base pan for elevating and lowering the lifting pan to and from a level corresponding to that of a raised vehicle wheel.

7. The tire jack according to claim 6 wherein said lifting means comprises:

a threaded lifting arm received within a fixed threaded nut, said lifting arm having an upper end and a lower end, said lower end having a first worm gear thereon, said upper end fixedly connected to said lifting pan;

a horizontal drive shaft having a first end and a second end, the first end having a second worn gear thereon that engages said first worm gear whereby rotation of said drive shaft results in rotation of said lifting arm through said threaded nut thereby raising and lowering said lifting arm.

8. The tire jack according to claim 7 wherein said drive shaft includes a sleeve at the second end thereof, said sleeve having a receptacle that is dimensioned and configured to tightly receive a lug wrench whereby rotation of the lug wrench rotates the drive shaft to raise and lower the lifting arm, and thus, the lifting pan.

9. The tire jack according to claim 6 wherein said base pan is mounted on a plurality of wheels allowing said base pan to easily roll along an underlying surface.

10. The tire jack according to claim 6 further comprising a plurality of juxtaposed rollers positioned within the open top of the lifting pan, said rollers arranged in a substantially concave fashion so as to readily conform to a vehicle tire and to assist a user in angularly orienting the tire when aligning wheel lugs with lug apertures on the tire.

11. A tire jack comprising:

a base pan;

a lifting pan superimposed on the base pan, said lifting pan having a substantially open top configured to support a tire;

a lifting means positioned within the base pan for elevating and lowering the lifting pan to and from a level corresponding to that of a raised vehicle wheel;

a plurality of juxtaposed rollers positioned within the open top of the lifting pan, said rollers arranged in a substantially concave fashion so as to readily conform to a vehicle tire and to assist a user in angularly orienting the tire when aligning wheel lugs with lug apertures on the tire.

12. The tire jack according to claim 11 wherein said lifting means comprises:

a threaded lifting arm received within a fixed threaded nut, said lifting arm having an upper end and a lower end, said lower end having a first worm gear thereon, said upper end fixedly connected to said lifting pan;

a horizontal drive shaft having a first end and a second end, the first end having a second worm gear thereon that engages said first worm gear whereby rotation of said drive shaft results in rotation of said lifting arm through said threaded nut thereby raising and lowering said lifting arm.

13. The tire jack according to claim 12 wherein said drive shaft includes a sleeve at the second end thereof, said sleeve having a receptacle that is dimensioned and configured to tightly receive a lug wrench whereby rotation of the lug wrench rotates the drive shaft to raise and lower the lifting arm, and thus, the lifting pan.

14. The tire jack according to claim 11 wherein said base pan is mounted on a plurality of wheels allowing said base pan to easily roll along an underlying surface.

15. The tire jack according to claim 11 wherein said lifting pan includes a plurality of shafts depending therefrom, each of said shafts received within a designated bore on the base pan, said shafts providing a bearing surface while assuring that the lifting pan remains substantially horizontal during lifting and lowering.

* * * * *